US010894273B1

(12) United States Patent
Minturn

(10) Patent No.: US 10,894,273 B1
(45) Date of Patent: Jan. 19, 2021

(54) METAL SEPARATION SYSTEM AND METHOD

(71) Applicant: Donna Maria Roberts, Portland, OR (US)

(72) Inventor: John Earl Minturn, Kansas City, MO (US)

(73) Assignee: Donna Maria Roberts, Portland, OR (US)

( * ) Notice: Subject to any disclaimer, the term of this patent is extended or adjusted under 35 U.S.C. 154(b) by 0 days.

(21) Appl. No.: 16/714,677

(22) Filed: Dec. 13, 2019

Related U.S. Application Data

(60) Provisional application No. 62/779,203, filed on Dec. 13, 2018.

(51) Int. Cl.

| | |
|---|---|
| ***B07B 13/11*** | (2006.01) |
| ***B07C 5/34*** | (2006.01) |
| ***B02C 23/08*** | (2006.01) |
| ***B07B 13/10*** | (2006.01) |

(52) U.S. Cl.
CPC ..... *B07C 5/34* (2013.01); *B02C 23/08* (2013.01); *B07B 13/10* (2013.01); *B07B 13/11* (2013.01); *B07C 2501/0036* (2013.01); *B07C 2501/0054* (2013.01)

(58) Field of Classification Search
CPC ..... B07B 13/10; B07B 13/11; B07B 13/16; B07C 5/34; B07C 2501/0036; B07C 2501/0054; B02C 23/08
USPC ..... 209/631, 635, 637, 638, 640, 641
See application file for complete search history.

(56) References Cited

U.S. PATENT DOCUMENTS

| | | | | |
|---|---|---|---|---|
| 2,096,594 A | | 10/1937 | Sanchez | |
| 2,666,524 A | * | 1/1954 | Payne | B07B 13/003 209/640 |
| 2,769,539 A | * | 11/1956 | Packman | B07B 13/116 209/615 |
| 2,932,393 A | * | 4/1960 | Leslic | B07B 13/003 209/640 |
| 3,109,262 A | | 11/1963 | Weaver et al. | |
| 4,195,735 A | * | 4/1980 | Facchinelli | B07B 13/003 209/510 |
| 4,375,853 A | * | 3/1983 | Feller | B07B 13/003 209/640 |
| 4,597,487 A | | 7/1986 | Crosby et al. | |
| 4,721,457 A | | 1/1988 | Areaux et al. | |
| 4,848,590 A | | 7/1989 | Kelly | |

(Continued)

OTHER PUBLICATIONS

Frank, Stephan; Innovation in Portable Hardness Testing, Article, Sep. 2001, 5 pages. Published at www.ndt.net.

(Continued)

*Primary Examiner* — Joseph C Rodriguez
(74) *Attorney, Agent, or Firm* — Green, Howard & Mughal, LLP; Karen Dana Oster

(57) ABSTRACT

A separator as described herein separates granular input material into component materials. Each component material has a hardness. The separator includes a rebound surface, a propulsion system, and a plurality of sorting zones. The propulsion system propels granular input material toward the rebound surface. The component materials that are rebounded off of the rebound surface and land in sorting zones based on the hardness of the component materials. A method for using the separator is also described.

8 Claims, 10 Drawing Sheets

(56) References Cited

U.S. PATENT DOCUMENTS

| | | | | |
|---|---|---|---|---|
| 4,895,209 | A * | 1/1990 | Margolin | A01D 17/10 171/18 |
| 5,271,506 | A * | 12/1993 | Haines | B07B 13/10 209/637 |
| 5,301,816 | A * | 4/1994 | Weber | B03B 9/061 209/616 |
| 7,674,994 | B1 | 3/2010 | Valerio | |
| 7,950,601 | B2 | 5/2011 | Watts | |
| 8,308,090 | B2 | 11/2012 | Watts | |
| 8,640,879 | B2 * | 2/2014 | Riise | B29B 17/02 209/638 |
| 8,678,306 | B2 | 3/2014 | Watts | |
| 9,403,167 | B2 | 8/2016 | Watts | |
| 9,409,210 | B2 * | 8/2016 | Berkhout | B07B 13/10 |
| 9,943,851 | B2 | 4/2018 | Watts | |
| 10,449,544 | B2 | 10/2019 | Watts | |
| 2014/0154080 | A1 | 6/2014 | Watts | |
| 2018/0311674 | A1 * | 11/2018 | de Vries | B07B 13/116 |

OTHER PUBLICATIONS

Electromatic Equipment Co., Inc.; Rebound Hardness Testers, Brochure, at least as early as Dec. 2019, 2 pages. Published at https://www.checkline.com/res/products/126781/QH5BrochureCheckline.pdf.

* cited by examiner

METAL SEPARATION SYSTEM AND METHOD

The present application is an application claiming the benefit of U.S. Provisional Patent Application No. 62/779,203, filed Dec. 13, 2018. The present application is based on and claims priority from this application, the disclosure of which is hereby expressly incorporated herein by reference in its entirety.

BACKGROUND

Described herein are a metal separation system and method. More specifically, described herein are an automated separator and a method for using the separator. The separator uses rebound hardness to separate a granular material having a mixture of materials into separate component materials.

Metal is valuable. As a general rule, recyclers or processing plants will pay a higher price for metals of higher quality and purity. Put another way, the more pure the metal, the more valuable it is. That is why scrap metal is less valuable than pure metal. Because metallic compounds only have a finite supply and the demand for metal materials is approaching infinite, recycling is becoming a necessity.

Recycling centers detect metals in recycled materials and then separate them from other (non-metal) components. Then the different types of metals must be sorted and separated. Some of the separation for large pieces of metal may be accomplished by hand sorting. While magnets can be used to detect and remove ferrous metals (e.g. steel, iron), magnets are ineffective for sorting nonferrous metals (e.g. aluminum). Separating intermingled nonferrous metals has historically required more complicated, expensive, or problematic techniques (e.g. x-ray detection and vacuum technology). Impurities may be removed from scrap after the metal sorting process. Removing impurities usually involves melting the metal down and refining it in a manner similar to removing the metal from its ore. Removing the impurities produces metals that are close to pure and ready for manufacturing into something new.

Grinders, shredders, and mills (jointly referred to as "grinders") are well known devices for reducing the particle size of a material. Some of these grinders are able to reduce inputted larger material to "particle size" (e.g. smaller than 0.5 inch in diameter). The granular material may then be removed from the grinder. Ground-up material can be sent to a landfill where it will take up less room than unprocessed material. If the material is to be shipped, it can be shipped more efficiently due to its reduced size and greater density.

U.S. Pat. No. 7,950,601 to Watts, U.S. Pat. No. 8,308,090 to Watts, and U.S. Pat. No. 8,678,306 to Watts (the "Watts patents") describe grinders and grinding methods. Running raw materials through the grinder produces granular materials ("particles") of small sizes. Running raw materials through the grinder for longer periods produces granular materials ("particles") of smaller sizes. Depending on the raw materials input into the grinder, the granular materials output from the grinder have different compositions that may include various metals (e.g. aluminum, brass, bronze, copper, and stainless steel). Processes have been devised to remove the non-metal components, but granular material having multiple types of metals still has relatively little value. Recyclers want granular material of a single type (at least relatively pure).

There are processes that have been devised to separate component metals from a mixture of metals. If the components are relatively large, this can be done by hand. U.S. Pat. No. 7,674,994 to Valerio is directed to a method and apparatus for sorting metal. U.S. Pat. No. 4,848,590 to Kelly is directed to an apparatus for the multisorting of scrap metals by X-ray analysis. But these systems are not really suitable for sorting granular material.

SUMMARY

Described herein are a metal separation system and method. More specifically, described herein are an automated separator and a method for using the automated separator. The separator uses rebound hardness to separate a granular material having a mixture of materials into separate component materials. Recyclers have no interest in a combination of various granular materials and they are unable to or unwilling to separate the materials. Using the separator described herein, the mixed granular input material is divided into a plurality of separated granular output materials. The separated granular output materials are relatively "pure" and, therefore, are much more valuable than the mixed granular input material.

Described herein is a separator for separating granular input material into component materials. Each component material has a hardness. The separator includes a rebound surface, a propulsion system, and a plurality of sorting zones. The propulsion system is for propelling granular input material toward the rebound surface. The sorting zones are arranged at increasing distances from the rebound surface. The component materials that are rebounded off of the rebound surface land in the sorting zones based on the hardness of the component materials. The component materials in the sorting zones are predominantly of a like hardness.

One preferred separator includes an annular rebound surface, uses a centrifugal propulsion system, and has concentric sorting zones. Another preferred separator includes an inclined rebound surface and uses a gravitational propulsion system.

Some preferred separators further include a pre-sorting system for pre-sorting the granular input material prior to the propulsion system propelling the granular input material toward the rebound surface. Some preferred separators further include a plurality of sorting containers, each sorting container associated with at least one of the sorting zones, and each sorting container receiving component material that landed in its associated at least one of the sorting zones.

Also described herein is a method for using a separator for separating granular input material into component materials. Each component material has a hardness. The method includes the steps of: (a) propelling inputted granular input material toward a rebound surface; (b) rebounding propelled granular input material off of the rebound surface; and (c) the component materials rebounding off of the rebound surface and landing in respective ones of a plurality of sorting zones based on the hardness of the component materials, the plurality of sorting zones arranged at increasing distances from the rebound surface. The method may also include the step of pre-sorting the granular input material prior to the step of propelling inputted granular input material.

One preferred method uses a centrifugal propulsion system, an annular rebound surface, and a plurality of concentric sorting zones. Another preferred method uses a gravitational propulsion system and an inclined rebound surface.

Objectives, features, combinations, and advantages described and implied herein will be more readily understood upon consideration of the following detailed description of the invention, taken in conjunction with the accompanying drawings. The subject matter described herein is also particularly pointed out and distinctly claimed in the concluding portion of this specification.

DESCRIPTION OF THE DRAWINGS

The accompanying drawings illustrate various exemplary separators, components of various exemplary separators, and/or provide teachings by which the various exemplary separators and their methods of use are more readily understood.

Figure 1A:
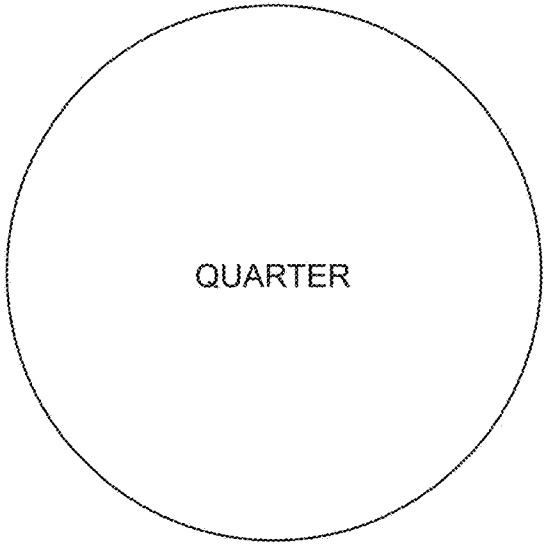
FIGS. 1A-1C are top views of a quarter and two groupings of input material having a mixture of component materials, and the particles of the mixed granular input material in the FIG. 1B grouping has an exemplary average size that is smaller than the exemplary average size of the particles of the mixed granular input material in the FIG. 1C grouping.

The drawing figures are not necessarily to scale. Certain features or components herein may be shown in somewhat schematic form and some details of conventional elements may not be shown or described in the interest of clarity and conciseness. The drawing figures are hereby incorporated in and constitute a part of this specification.

DETAILED DESCRIPTION

The automated separators 100, 170 (metal separation systems) and methods for using the separators 100, 170 described herein use rebound hardness to separate a granular input material 110 having a mixture of materials (individually represented as M1, M2, and M3) into separate component materials (contained, respectively, within M1 container, M2 container, and M3 container).

Figure 1C:
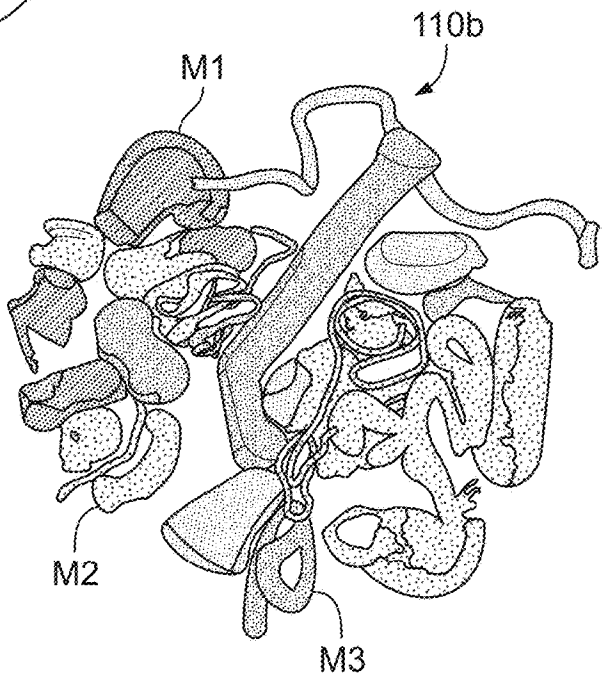
Figure 1B:
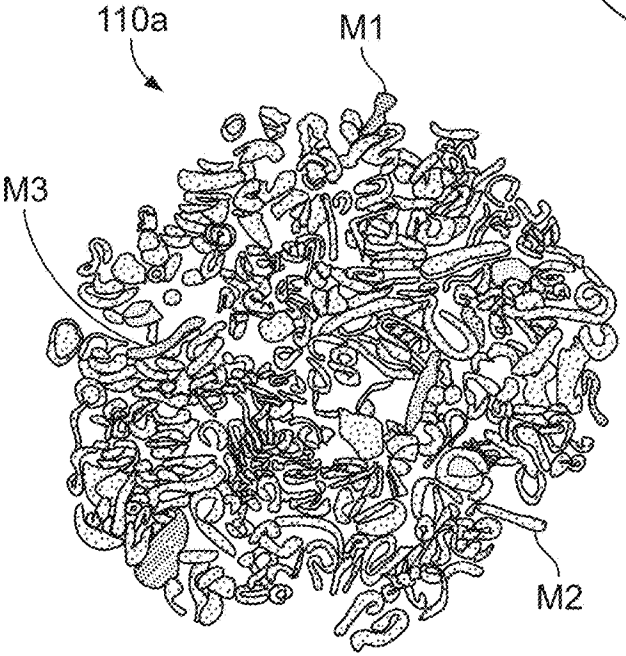

FIGS. 1A-1C show a quarter (FIG. 1A) and two groupings (FIGS. 1B-1C) of exemplary mixed granular input material 110*a*, 110*b* (jointly referred to as "mixed granular input material 110," "granular input material 110," or "input material 110") having a mixture of component materials (individual or component materials represented as M1, M2, and M3). FIG. 1A shows a quarter that helps to show the relative size of the particles of FIG. 1B and particles of FIG. 1C. The particles of the material in the input material 110*a* grouping has an exemplary average size that is smaller than the exemplary average size of the particles of the material in the input material 110*b* grouping. These sizes are meant to be exemplary and are not meant to be limiting such that some particles may be smaller than the smallest shown particle, larger than the largest shown particle, and in between the sizes of the shown particles. Although the particles specifically do not need to be homogenous in size and shape, preferably they are of roughly similar size and shape.

Figure 2:
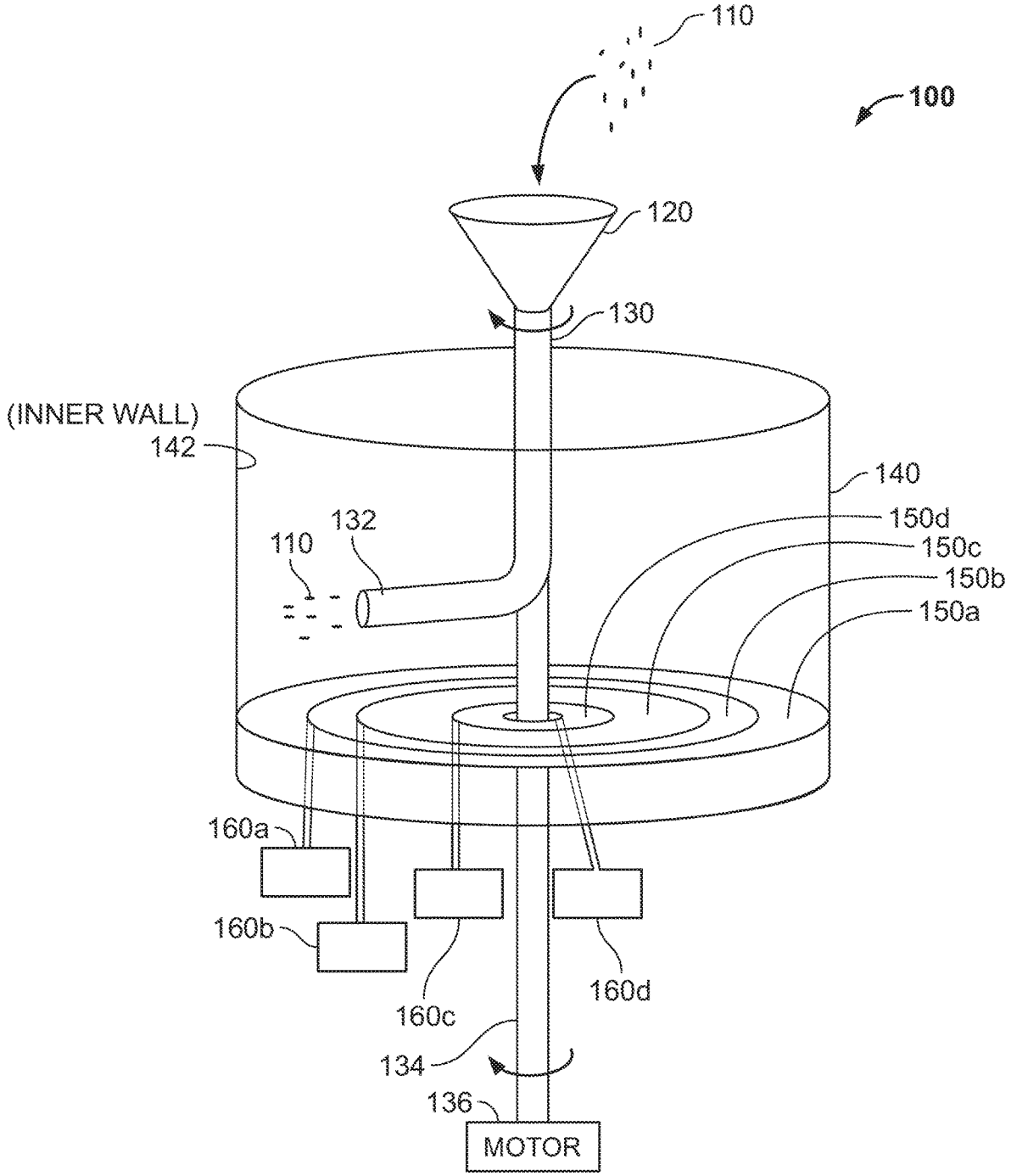
FIG. 2 is a side perspective view of a preferred exemplary separator with an annular rebound surface surrounding concentric sorting zones.
Figure 11:
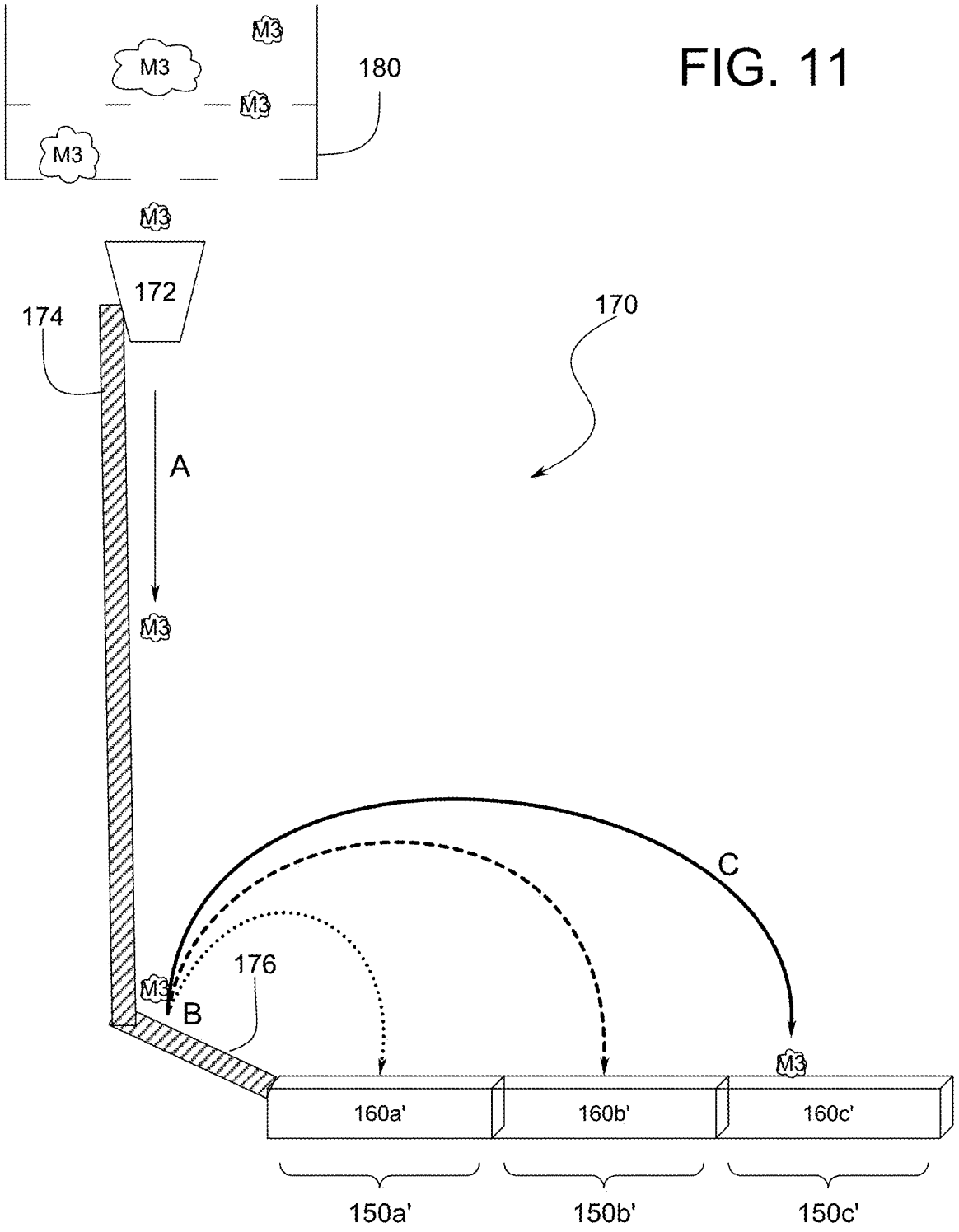
FIG. 11 is a side view of an alternative exemplary separator with a rebound surface with a plurality of sorting zones positioned at increasing distances from the rebound surface.

FIG. 2 is a side perspective view of a preferred exemplary separator 100. The shown separator 100 includes an optional funnel 120, input/discharge/propulsion structure (130, 132, 134, 136), rebound structure (140, 142), sorting zones 150, and sorting containers 160. These will be discussed in detail herein. FIG. 11 shows an alternative exemplary separator 170 that includes input/discharge/propulsion structure (174), rebound structure (176), sorting zones 150' (shown as sorting zones 150*a*', 150*b*', 150*c*'), and sorting containers 160' (shown as M1 container 160*a*', M2 container 160*b*', and M3 container 160*c*').

Exemplary separators and methods for using the separators may be better understood with reference to the drawings, but these are not intended to be of a limiting nature. The same reference numbers will be used throughout the drawings and description in this document to refer to the same or like parts. The shown shapes and relative dimensions are preferred, but are not meant to be limiting unless specifically claimed, in which case they may limit the scope of that particular claim.

Before describing the separators, methods for using the separators 100, and figures, some of the terminology should be clarified. Please note that the terms and phrases may have additional definitions and/or examples throughout the specification. Where otherwise not specifically defined, words, phrases, and acronyms are given their ordinary meaning in the art. The following paragraphs provide basic parameters for interpreting terms and phrases used herein.

The phrases "granular material" (a general term), "input material" (or "mixed granular input material" is the granular material 110 that is inserted into the separator 100), and "output material" (or "separated granular output material" is the granular material that exits from the separator 100) are generally meant to include a granular material that resembles or consists of small "grains" or "particles." For purposes of discussion, the mixed granular input material 110 includes a combination of various granular materials including metals (e.g. aluminum, brass, bronze, copper, and stainless steel). The metallic granular materials can be recovered from recycling operations, such as the recycling of automobiles. The granular materials (including both input and output materials) preferably (or at least, most likely) includes grains or particles in a mixture of roughly similar size and shape, although the granular materials specifically do not have to be completely homogenous in size and shape. The input material preferably (or at least, most likely) is a mixture of individual or component materials (individually represented as M1, M2, and M3). The output materials are generally the separated component materials (individually represented as M1, M2, and M3). A table of exemplary predominant metals of the input mixture and ranges of their properties follows:

| Metal | Range of Rockwell Hardness (range) | Hardness normalized to copper | Range of Densities (PCF) | Density normalized to aluminum |
|---|---|---|---|---|
| Copper | 10 | 1 | 560 | 3.3 |
| Aluminum | 20-60 | 2-6 | 170 | 1 |
| Brass | 55-65 | 5.5-6.5 | 480-550 | 2.8-3.2 |
| Bronze | 75 | 7.5 | 460-560 | 2.7-3.3 |
| Stainless steel | 80 | 8 | 470-500 | 2.7-2.9 |

The term "hardness" is meant to describe a characteristic of a material. While hardness is an inherent property of all materials (including metal), there are different measurements of hardness including scratch hardness, indentation hardness, and rebound hardness. The phrase "hardness scale" is meant to describe a standardized way of measuring hardness. Exemplary hardness scales include, but are not limited to the Leeb Rebound Hardness Test (which uses the Leeb hardness value HL), the Bennett Hardness Scale, the Rockwell Hardness Scale, and the Brinell Hardness Scale. Rebound hardness, also known as dynamic hardness, measures the height of the "bounce" of a diamond-tipped hammer dropped from a fixed height onto a material. The Leeb Rebound Hardness Test and the Bennett Hardness Scale are particularly related to rebound hardness. While the present invention does not necessarily measure hardness (although it theoretically could measure hardness) and the scale is not particularly relevant, the present invention uses the inherent characteristic of materials having different rebound hardnesses in order to sort materials of different rebound hardnesses. The harder the material, the higher the rebound velocity and the displayed hardness value. Further, the separator 100 described herein uses the principle that harder materials rebound further off the rebound surface 142 than softer materials which rebound closer off the rebound surface 142. Similarly, the separator 170 (FIG. 11) described herein uses the principle that harder materials rebound further off the rebound surface 176 than softer materials rebound closer off the rebound surface 176.

The phrase "propulsion force" is meant to include any force that can propel granular input material 110 toward a rebound surface 142, 176. Exemplary propulsion forces include, but are not limited to centrifugal force, gravitational force, pneumatic force, mechanical force, and any other propulsion force known or yet to be discovered. The separator 100 is shown as using centrifugal force to propel granular input material 110 toward an annular rebound surface 142. The separator 170 is shown as using centrifugal force to propel granular input material 110 toward a rebound surface 176. Propulsion could also be accomplished using a machine similar to a sandblaster. The propulsion system (general term) would be the system designed to implement the propulsion force. A centrifugal propulsion system uses centrifugal force to propel the granular input material 110. A gravitational propulsion system uses gravity to propel the granular input material 110. A pneumatic propulsion system uses pneumatic force to propel the granular input material 110. A mechanical propulsion system uses mechanical force to propel the granular input material 110.

The term "associated" is defined to mean integral or original, retrofitted, attached, connected (including functionally connected), positioned near, and/or accessible by. For example, if the funnel 120 is associated with the top of the input tube 130, the funnel 120 may be directly attached, indirectly attached (via additional structure), functionally attached (e.g. hovering above), and/or rotatably attached (to allow rotation of the input tube).

It should be noted that relative terms (e.g. short and long, hard and soft, higher and lower, near and far) are meant to help in the understanding of the technology and are not meant to limit the scope of the invention. Similarly, unless specifically stated otherwise, the terms "first" and "second" are meant solely for purposes of designation and not for order or limitation. For example, the "first inclined surface 174" has no order relationship with the "second inclined surface 176."

It should be noted that some terms used in this specification are meant to be relative. For example, the term "top" is meant to be relative to the term "bottom." The term "front" is meant to be relative to the term "back." Rotation of the system or component that would change the designation might change the terminology, but not the concept.

The terms "may," "might," "can," and "could" are used to indicate alternatives and optional features and only should be construed as a limitation if specifically included in the claims. It should be noted that the various components, features, steps, or embodiments thereof are all "preferred" whether or not it is specifically indicated. Claims not including a specific limitation should not be construed to include that limitation.

Unless specifically stated otherwise, the term "exemplary" is meant to indicate an example, representation, and/or illustration of a type. The term "exemplary" does not necessarily mean the best or most desired of the type.

It should be noted that, unless otherwise specified, the term "or" is used in its nonexclusive form (e.g. "A or B" includes, but is not limited to, A, B, A and B, or any combination thereof). It should be noted that, unless otherwise specified, "and/or" is used similarly (e.g. "A and/or B" includes, but is not limited to, A, B, A and B, or any combination thereof). It should be noted that, unless otherwise specified, the terms "includes," "has," and "contains" (and variations of these terms) mean "comprises" (e.g. a device that "includes," "has," or "contains" A and B, comprises A and B, but optionally may contain C or additional components other than A and B).

It should be noted that, unless otherwise specified, the singular forms "a," "an," and "the" refer to one or more than one, unless the context clearly dictates otherwise. Similarly, unless specifically limited, the use of singular language (e.g. "component," "module," or "step") may include plurals (e.g. "components," "modules," or "steps"), unless the context clearly dictates otherwise.

Pre-Sorting

Although the particles of the mixed granular input material 110 specifically do not need to be homogenous in size and shape, preferably they are of roughly similar size and shape. The granular input material 110 being relatively homogenous could increase the efficiency of the separator 100, 170. For that reason, optional pre-sorting 200 (FIG. 12) may be performed. It should be noted that pre-sorting may be done based on characteristics including, but not limited to, size, weight, shape, material, and any other characteristic known or yet to be discovered.

Pre-sorting systems would be based on the type of pre-sorting to be accomplished. For exampling a size pre-sorting system would be a size measuring system (see the screen size pre-sorting system 180 (FIG. 11) described below). A weight pre-sorting system would be a weight measuring system (e.g. a scale). A shape pre-sorting system would use a system that sorted by scale (e.g. photos or scans and shape recognition software). A material pre-sorting system would use a system to separate based on types of materials (e.g. a magnet that removed ferrous material).

As an example, one type of pre-sorting uses a series of screens (size pre-sorting system 180 (FIG. 11)) to sort mixed granular input material 110 by size before using the separator 100 to sort the mixed granular input material 110. Size pre-sorting may be accomplished using a series of screens of different coarseness. For example, passing mixed granular input material 110 through a first screen that is very coarse, will "catch" component materials that are too big to fit through the large screen openings. Then, passing the remaining mixed granular input material 110 through a second screen that is "medium" coarse, will "catch" component materials that are too big to fit through the medium screen openings. Passing the remaining mixed granular input material 110 through a third screen that is only has small openings (fine or not coarse), will "catch" component materials that are too big to fit through the small screen openings leaving only the finest component materials to pass through. This would result in the mixed granular input material 110 being divided into four levels of coarseness: large (component materials caught by the first screen), medium (component materials caught by the second screen), small (component materials caught by the third screen), and fine (component materials that passed through the third screen).

As an example, another type of pre-sorting uses magnets (material pre-sorting system) to sort mixed granular input material 110 by material (removing ferrous material) before using the separator 100 to sort the mixed granular input material 110.

Optional Funnel 120

As shown in FIG. 2, an optional funnel 120 may be used as a starting point into which granular input material 110 is input into the separator 100. The bottom of the funnel 120 is associated with the top of the input tube 130. The funnel 120 may be attached to input tube 130 if both components rotate. On the other hand, the funnel 120 may be rotatably attached to the input tube 130 such that the funnel 120 remains immobile while the input tube 130 rotates. Another possibility is that the funnel 120 hovers above the input tube 130 which would also allow the funnel 120 to remain immobile while the input tube 130 rotates.

Granular input material 110 may be input into the top of an optional funnel 120 and exit from the bottom of the funnel 120. Granular input material 110 exiting from the bottom of the funnel 120 enters the top of the input tube 130. If there is no funnel 120, the granular input material 110 may be input directly into the top of the input tube 130.

A hopper may be used instead of or in addition to the funnel 120. A hopper may replace the funnel 120 and function in a similar matter except that it may have additional storage capabilities. A hopper with additional storage capabilities could also be added to the system (most likely above the funnel 120).

Input/Discharge/Propulsion Structure (130, 132, 134, 136)

The separator 100 shown in FIG. 2 uses an input/discharge/propulsion system that includes an input tube 130, a discharge tube 132, a central shaft 134, and a motor 136 (e.g. a variable speed motor). Rotating components (e.g. the discharge tube 132) and the motor 136 form an exemplary centrifugal propulsion system. As shown in FIGS. 2-6, the granular input material 110 is propelled (using propulsion force A) toward the inner surface 142 of the cylindrical rebound chamber 140.

As shown, the input tube 130 is centrally located along and parallel to the center axis of the of the cylindrical rebound chamber 140. The hollow discharge tube 132 is shown at an approximately 90 degree angle (right angle) to the input tube 130. (The discharge tube 132 is formed to efficiently accommodate and propel mixed granular input material 110 of different sizes and compositions. The discharge tube 132 may also be replaceable and/or modifiable.) The central shaft 134 is shown as being substantially a downward extension of the input tube 130.

Figure 3:
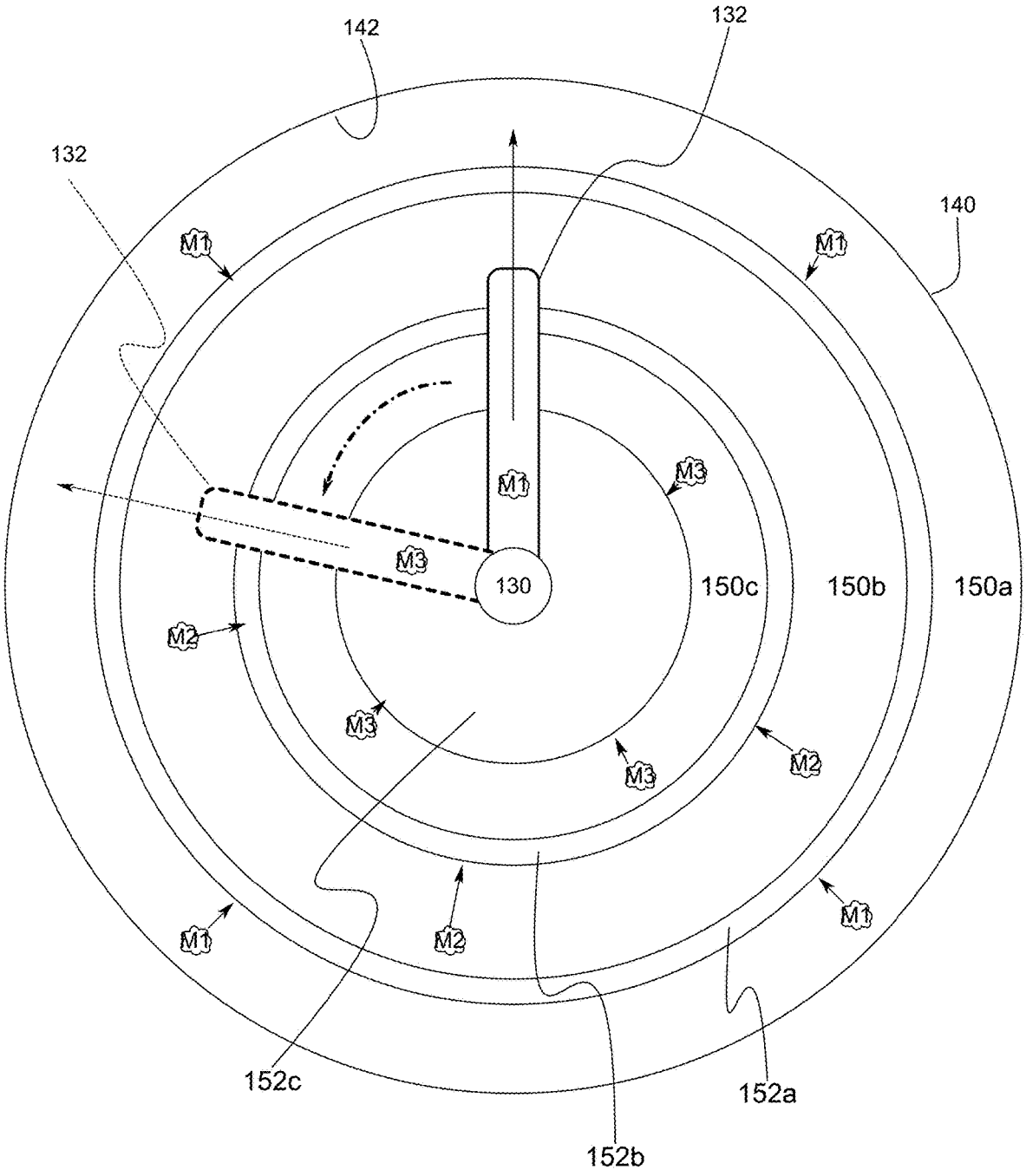
FIG. 3 is a top view of a preferred exemplary separator showing sorting zones as concentric sorting zones, with mixed granular input material being propelled against a surface, granular input material rebounding off the surface, and granular input material dropping/landing in sorted zones.

Rotation is used to create the propulsion force (centrifugal force) of the separator 100. The motor 136 creates the centrifugal force by rotating one or more of the input tube 130, discharge tube 132, and/or central shaft 134. Preferably at least the discharge tube 132 is rotated (FIG. 3 shows the discharge tube 132 at a first position (solid) and rotated to a second position (dashed)) at a speed where the granular input material 110 is discharged by the centrifugal force with enough energy to force the discharged particles of the granular input material 110 to strike the inner rebound surface 142 of the rebound chamber 140 and rebound toward the center of the rebound chamber 140. Centrifugal force (and possibly one or more other propulsion force(s)) propels the granular input material 110 toward the inner rebound surface 142 of a rebound chamber 140. Put another way, the separator 100 uses centrifugal force to propel the granular input material 110 through the discharge tube 132 and toward the inner rebound surface 142 of the rebound chamber 140.

In addition to the propulsion force, vacuum may be used to enhance or encourage the flow of the granular input material 110 through the separator 100 (e.g. through the input tube 130 and/or the discharge tube 132). For example, the rebound chamber 140 and/or the attached sorting containers 160 may be maintained in a state of vacuum caused by an integral vacuum pump (not shown).

The shown structure, orientation, and interconnection of the input tube 130, discharge tube 132, and central shaft 134 are meant to be exemplary. As shown, the hollow input tube 130 is vertical and the hollow discharge tube 132 is at an angle (shown as an approximately 90 degree angle) to the input tube 130. Alternatively, the input tube 130 and the discharge tube 132 could be substantially inline with each other and at an angle (e.g. 45 degrees) to the vertical axis of the cylindrical rebound chamber 140. Another variation could have the motor 136 positioned above the rebound chamber 140 and directly rotating the input tube 130 (such that the input tube 130 also functions as the central shaft 134). Although the motor 136 is shown as being attached directly to the central shaft 134, it could alternatively be indirectly attached to the central shaft 134.

Figure 4:
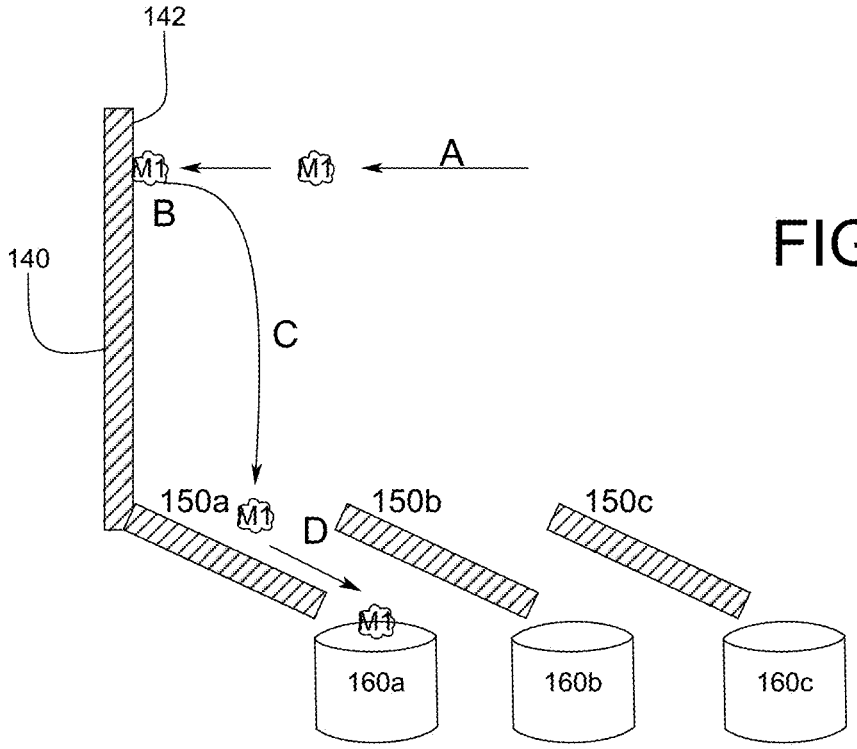
FIG. 4 is an at least partial side view of a preferred exemplary separator showing sorting zones, material M1 being propelled A against a surface, rebounding B off the surface, dropping C in sorted zones, and proceeding D to an M1 container.
Figure 5:
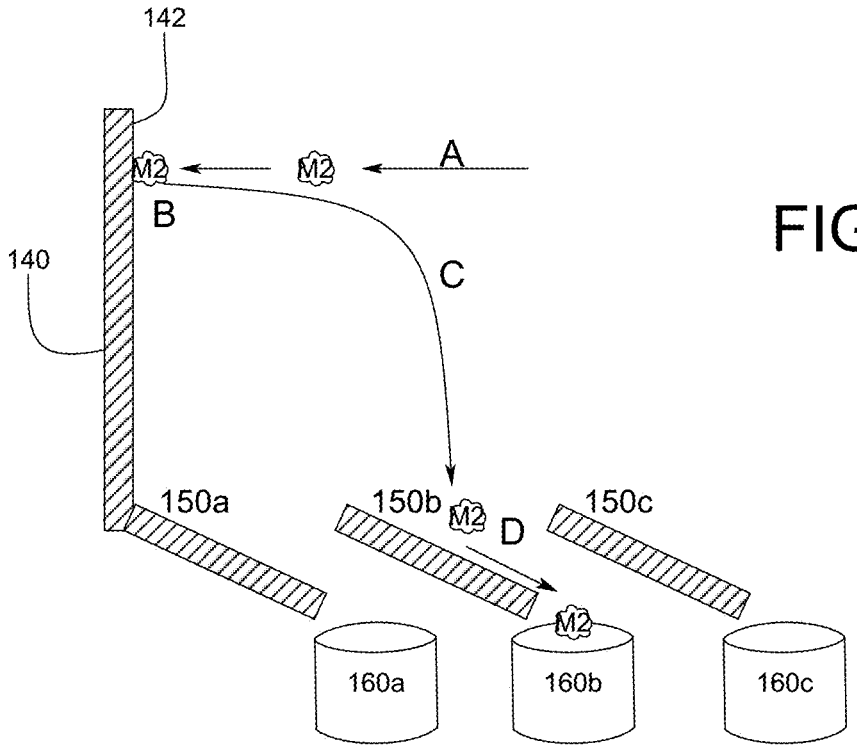
FIG. 5 is an at least partial side view of a preferred exemplary separator showing sorting zones, material M2 being propelled A against a surface, rebounding B off the surface, dropping C in sorted zones, and proceeding D to an M2 container.
Figure 6:
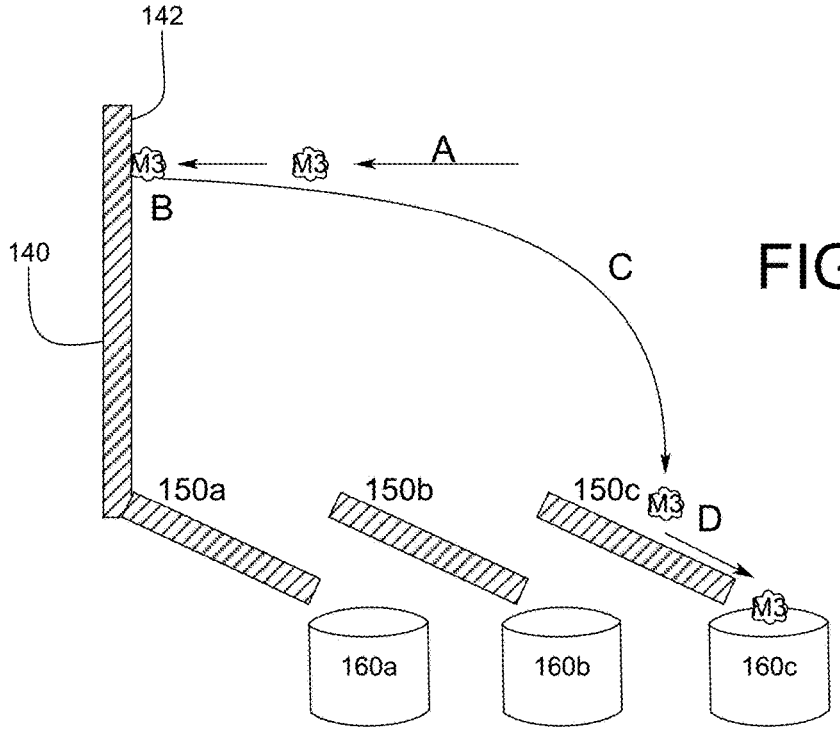
FIG. 6 is an at least partial side view of a preferred exemplary separator showing sorting zones, material M3 being propelled A against a surface, rebounding B off the surface, dropping C in sorted zones, and proceeding D to an M3 container.

The motor 136 may be a variable speed motor. Adjusting (increasing/decreasing) the speed of the motor adjusts (increases/decreases) the speed of the rotation of the discharge tube 132 which, in turn, adjusts (increases/decreases) the propulsion force (centrifugal force) acting upon the granular input material 110. Adjusting (increasing/decreasing) the propulsion force adjusts (increases/decreases) the distance the component materials M1, M2, M3 travel and the rebound or "drop" curve C (FIGS. 4-6).

Rebound Structure (140, 142)

FIG. 2 shows a cylindrical rebound chamber 140 (also referred to as the "rebound chamber 140") having an annular inner surface 142 (also referred to as the "rebound surface 142," "annular wall 142," "cylindrical rebound surface 142," "inner rebound surface 142") and a lower portion divided into a plurality of concentric sorting zones 150*a*, 150*b*, 150*c* (jointly referred to as sorting zones 150). The rebound chamber 140 and inner surface 142 are jointly referred to as rebound structure (140, 142). The rebound chamber 140 may have a lid (not shown). The annular wall 142 may be made of a sturdy material such as steel.

As shown in FIGS. 2-6, the granular input material 110 is propelled (using propulsion force A (FIGS. 4-6)) toward the annular wall 142 of the rebound chamber 140. The propelled granular input material 110 rebounds B (FIGS. 4-6) off of the inner surface 142 a distance based upon the hardness of each separate component material M1, M2, M3. FIG. 3 shows the separate component materials M1, M2, M3 after they rebound B (FIGS. 4-6) and drop C (FIGS. 4-6) in their respective concentric sorting zones 150*a*, 150*b*, 150*c*. Put another way, component material M1, M2, M3 have different hardness characteristics allowing the granular input material 110 to be separated based on the distance they rebound (concentric sorting zones 150*a*, 150*b*, 150*c*) off of a solid structure having a rebound surface (inner surface 142). The properties of the component material M1, M2, M3 and the inner surface 142 dictate the distance each component material M1, M2, M3 will rebound from the inner surface 142. Granular input material 110 with a high hardness rebound with more energy (and travel farther) than granular input material 110 with lesser hardness.

Sorting Zones 150

The lower portion of the rebound chamber 140 is divided into a plurality of concentric sorting zones 150*a*, 150*b*, 150*c* (jointly referred to as sorting zones 150). From the sorting zones, the sorted component materials M1, M2, and M3 may be transferred to respective containers 160*a*, 160*b*, 160*c* (jointly referred to as sorting containers 160).

Figure 7:
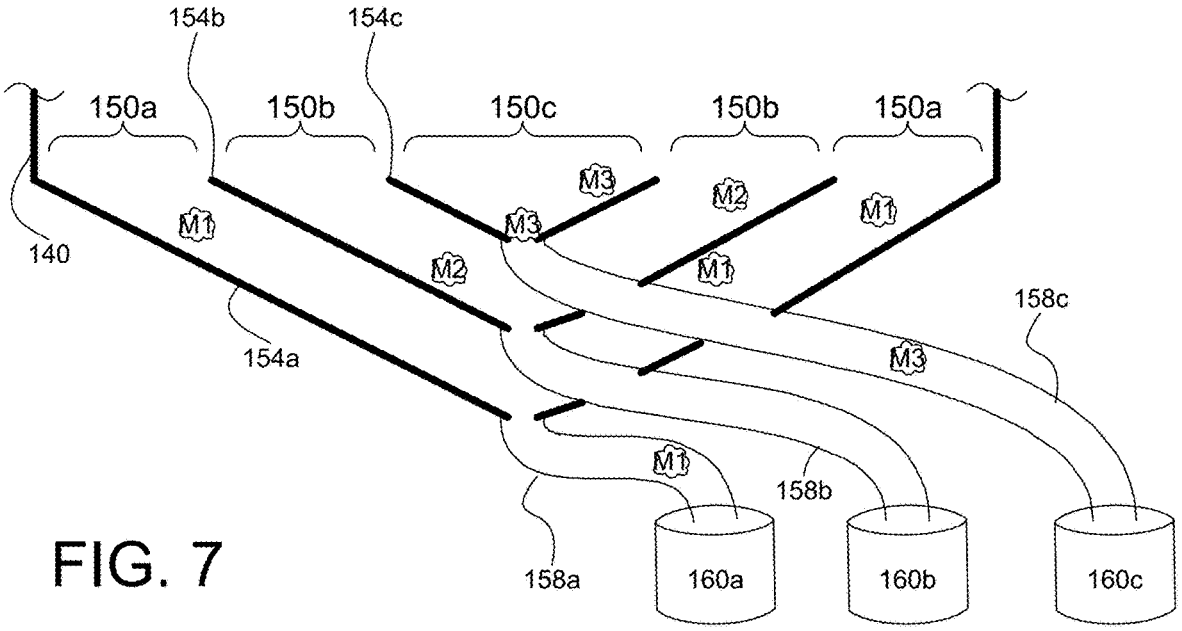
FIG. 7 is a simplified cross-sectional view of the bottom portion of a preferred exemplary separator showing concentric conical sorting zones with sorted material M1, M2, M3 proceeding D to respective M1, M2, M3 containers.
Figure 8:
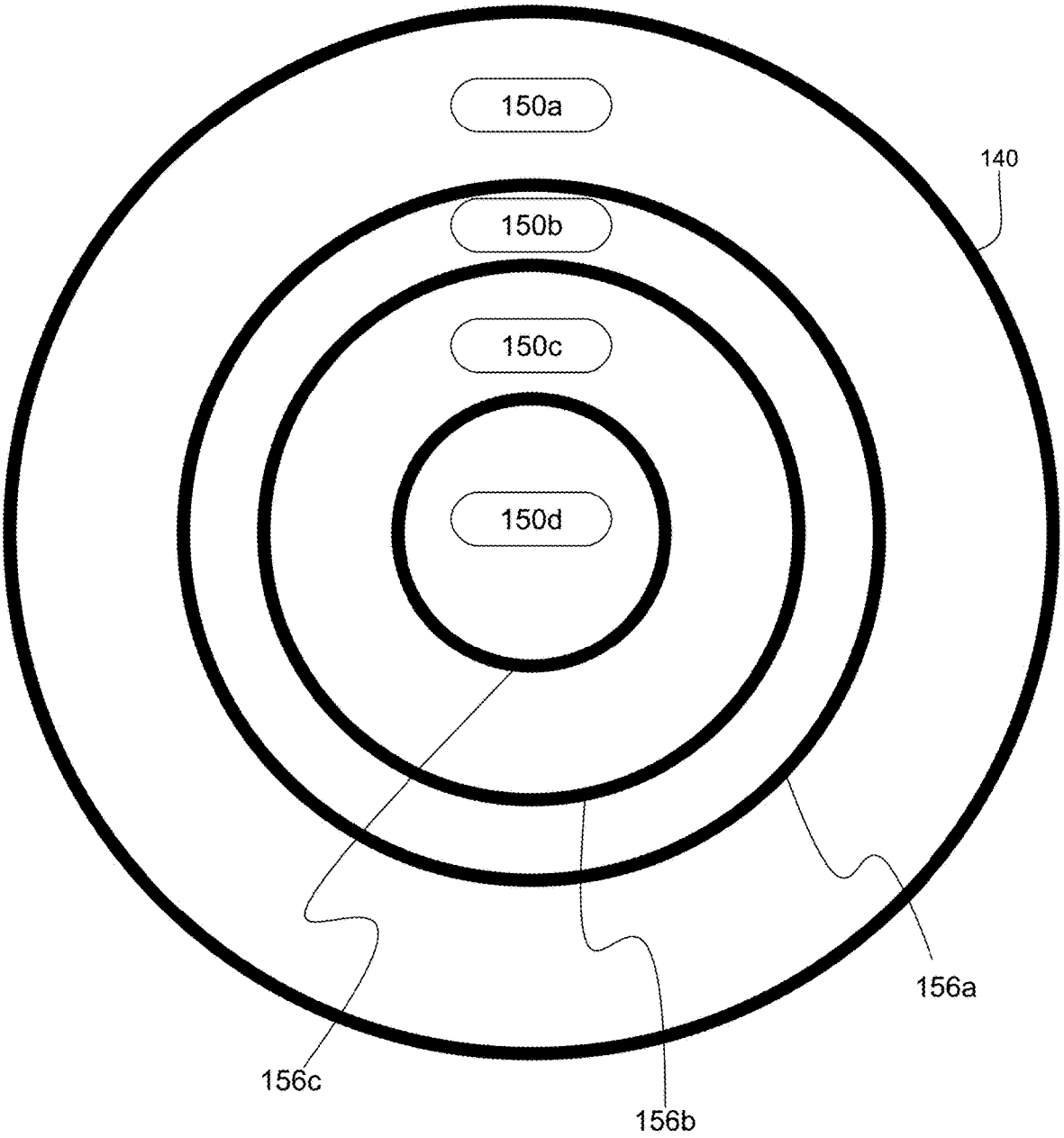
FIG. 8 is a top view of a preferred exemplary separator floor with concentric sorting zones, the zones being annular openings with annular border walls therebetween.

The concentric sorting zones 150*a*, 150*b*, 150*c* may be implemented in many different ways. For example, in FIG. 2, the sorting zones 150 are annular flat surfaces with narrow annular gaps therebetween. In FIGS. 3-6 (which shows at least a partial lower portion of a separator that could be used instead of the lower portion of the separator shown in FIG. 2), the sorting zones 150 are annular downwardly-angled (lower toward the center) surfaces with annular gaps 152*a*, 152*b*, 152*c* therebetween. In FIG. 7 (which shows at least a partial lower portion of a separator that could be used instead of the lower portion of the separator shown in FIG. 2), the sorting zones 150 are created as the openings between the annular upper edges of nested cones 154*a*, 154*b*, 154*c*. In FIG. 8 (which shows at least a partial lower portion of a separator that could be used instead of the lower portion of the separator shown in FIG. 2), the sorting zones 150 (including sorting zones 150*a*, 150*b*, 150*c*, 150*d*) are created as the openings between the annular upper edges of the annular border walls 156*a*, 156*b*, 156*c* of concentric cylinders or tubes.

As shown in FIGS. 2-6, the granular input material 110 is propelled (using propulsion force A (FIGS. 4-6)) toward the inner surface 142 of the rebound chamber 140. The propelled granular input material 110 rebounds B off of the inner surface 142 a distance based upon the hardness of each separate component material M1, M2, M3. FIG. 3 shows the separate component materials M1, M2, M3 after they rebound B (FIGS. 4-6) and drop C (FIGS. 4-6) in their respective concentric sorting zones 150*a*, 150*b*, 150*c*. FIG. 4 shows relatively soft component material M1 rebounding B and traveling only a short distance along a rebound curve C. FIG. 5 shows medium-hardness component material M2 rebounding B and traveling a medium distance along a rebound curve C. FIG. 6 shows relatively hard component material M3 rebounding B and traveling a longer distance along a rebound curve C. This process results in each of the sorting zones 150 containing component materials predominantly of a like hardness.

Figure 9:
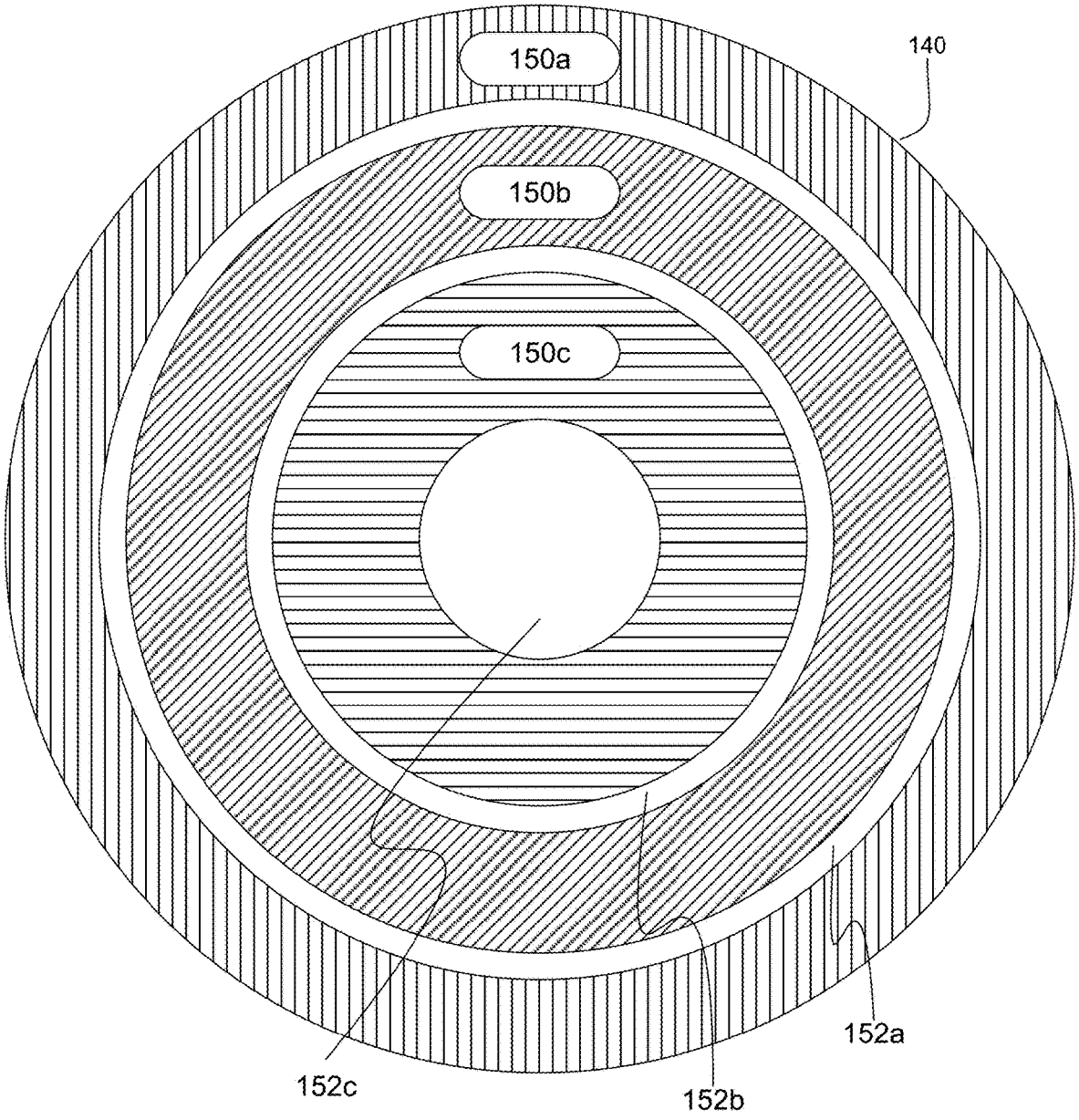
FIG. 9 is a top view of a preferred exemplary separator floor with concentric sorting zones, the zones having roughly equal areas and annular gaps therebetween.
Figure 10:
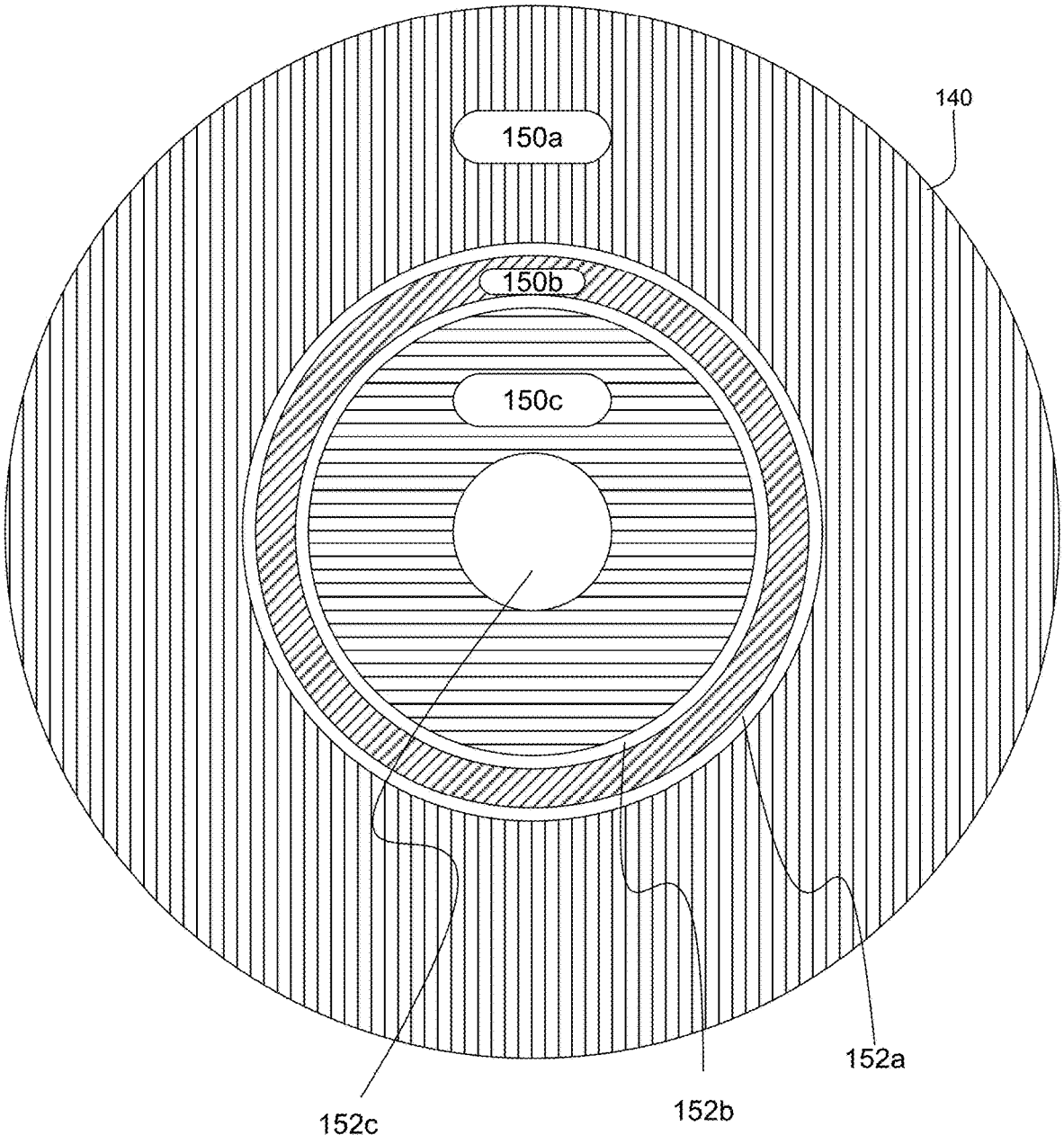
FIG. 10 is a top view of a preferred exemplary separator floor with concentric sorting zones, the zones having unequal areas and annular gaps therebetween.

The respective sizes of the zones 150 are dependent upon the separate component materials M1, M2, M3. FIGS. 9 and 10 show exemplary zone sizing. FIG. 9 (which shows at least a partial lower portion of a separator that could be used instead of the lower portion of the separator shown in FIG. 2) shows the zones 160 having roughly equal areas and annular gaps therebetween. FIG. 10 (which shows at least a partial lower portion of a separator that could be used instead of the lower portion of the separator shown in FIG. 2) shows the zones 160 having unequal areas and annular gaps therebetween. Adjusting (increasing/decreasing) the speed of the variable speed motor 136 can also affect the distance the component materials M1, M2, M3 travel and the rebound curve C (FIGS. 4-6) relative to the sizes of the sorting zones 150.

It should be noted that the sorting zones 150 may be fixed sizes, may be removable and replaceable so that different sizes may be used, and/or may be manually or automatically adjustable. Allowing for different sized sorting zones 150 or the adjustability of sorting zones 150 would be advantageous to accommodate different compositions of the mixed granular input material 110.

Sorting Containers 160

The separate component materials M1, M2, M3, once sorted into their respective sorting zones 150, travel, are transferred, and/or are transported (e.g. fall, slide, and/or are pulled) into respective sorting containers 160*a*, 160*b*, 160*c* (jointly referred to as sorting containers 160) for collecting the separate component materials M1, M2, M3. This process results in each of the sorting containers 160 containing component materials predominantly of a like hardness. The sorting container 160*a* associated with the sorting zone 150*a* closest to the rebound surface 142 preferably captures and/or stores the component materials M1 with the lowest hardness because the rebound distance is relatively short. The sorting container 160*c* associated with the sorting zone 150*c* farthest from the rebound surface 142 preferably capture(s) and/or store(s) the component materials M3 with the highest hardness because the rebound distance is relatively long.

The transfer or transport can be aided by gravity if the sorting containers 160 are lower than the sorting zones 150. They can also be aided by surface angles (e.g. downwardly slanted surfaces that encourage downward movement). Tubes or transport channels (shown as tubes or transport channels 158*a*, 158*b*, 158*c* in FIG. 7) may be used to direct the flow of the component materials M1, M2, M3. A vacuum can be applied to the sorting containers 160 and/or transport channels 158*a*, 158*b*, 158*c* to assist in drawing in the separate component materials M1, M2, M3 toward the sorting containers 160. Although not shown, scrapers, guides, and/or other mechanical mechanisms can be used to assist in the transfer of component materials M1, M2, M3 into their respective sorting containers 160.

Using FIGS. 2-6 as an example, after rebounding B, the component materials M1 with the lowest hardness "fall" along rebound curve C and "land" in sorting zone 150*a* (the zone closest to the rebound surface 142). Gravity, surface angles, and/or a vacuum causes the component materials M1 to enter sorting container 160*a*. Similarly, after rebounding B, the component materials M3 with the highest hardness "fall" along rebound curve C and "land" in sorting zone 150*c* (the zone farthest from the rebound surface 142). Gravity, surface angles, and/or a vacuum causes the component materials M3 to enter sorting container 160*c*.

Using FIG. 7 as another example, after the component materials M1 with the lowest hardness "land" in sorting zone 150*a* (the zone closest to the rebound surface 142), gravity, surface angles, and/or a vacuum causes the component materials M1 to flow through transport channel 158*a* and enter sorting container 160*a*. Similarly, after the component materials M3 with the highest hardness "land" in sorting zone 150*c* (the zone farthest from the rebound surface 142), gravity, surface angles, and/or a vacuum causes the component materials M3 to flow through transport channel 158*c* and enter sorting container 160*c*.

It should be noted that the containers 160 may be fixed sizes, may be removable and replaceable so that different sizes may be used, and/or may be manually or automatically adjustable. Allowing for different sized containers 160 or the adjustability of containers 160 would be advantageous to accommodate different compositions of the mixed granular input material 110.

Alternative Separator 170

FIG. 11 shows an alternative separator 170 that uses gravity as the propulsion force. Using the alternative separator 170, granular input material 110 is "dropped." The components used in "dropping" (e.g. the optional funnel 172 and/or the inclined surface 174) form an exemplary gravitational propulsion system. This alternative separator 170 includes a first inclined surface 174 (also referred to as "guide surface 174"), a second inclined surface 176 (also referred to as "rebound surface 176" or "rebound ledge 176"), and a plurality of containers (e.g. M1 container 160*a*', M2 container 160*b*', and M3 container 160*c*').

An optional funnel 172 may be used as a starting point for "dropping" granular input material 110. Granular input material 110 input into the top of the funnel 172 exits from the bottom of the funnel 172. A hopper may be used instead of or in addition to the funnel 172. A hopper may replace the funnel 172 and function in a similar manner except that it may have additional storage capabilities. A hopper with additional storage capabilities could also be added to the system (most likely above the funnel 172). The granular input material 110 exiting through the bottom of the funnel 172 is shown in this figure only as the singular separate component material M3, although all the components of the granular input material 110 would be "dropped" simultaneously.

The granular input material 110 are propelled A (accelerated due to gravitational force) along the first inclined surface 174. Additional downward propulsion forces (e.g. pneumatic forces) may be used in addition to gravity. The first inclined surface 174 may be a steel inclined surface. As opposed to being vertical, the first inclined surface 174 may be slightly backwardly angled at an angle such as 75 degrees to 89 degrees (e.g. at 88 degrees) relative to the level ground.

At the bottom of the first inclined surface 174, the propelled granular input material 110 hits and rebounds B from the rebound surface 176 along a rebound curve C. The second inclined surface 176 may be a steel inclined surface. The rebound surface 176 is associated with the guide surface 174 at an angle such as 93 degrees to 135 degrees (e.g. at 93 degrees). It should be noted that the angle may be fixed or may be manually or automatically adjustable depending on the composition of the mixed granular input material 110.

Below the rebound surface 176 are slots or containers 160' (e.g. M1 container 160*a*', M2 container 160*b*', and M3 container 160*c*' (jointly referred to as containers 160')) that function as sorting zones 150*a*', 150*b*', 150*c*' (jointly referred to as sorting zones 150'). The sorting zones 150' are positioned at increasing distances from the rebound surface (and rebound point B). The materials M1, M2, and M3 land in respective sorting zones 150' according to their hardness. This process results in each of the sorting zones 150' and/or sorting containers 160' containing component materials predominantly of a like hardness. It should be noted that the sorting zones 150' and the containers 160' of alternative separator 170 are not shown as concentric circles or otherwise nested.

It should be noted that the sorting zones 150' and containers 160' may be fixed sizes, may be removable and replaceable so that different sizes may be used, and/or may be manually or automatically adjustable. Allowing for different sized sorting zones 150' and containers 160' or the adjustability of sorting zones 150' and containers 160' would be advantageous to accommodate different compositions of the mixed granular input material 110.

The rebound curve C is dependent on the hardness of the respective granular input material 110 (M1, M2, M3). Put another way, softer materials (e.g. M1) follow the dotted line trajectory and rebound closer off the rebound surface 176 into M1 container 160*a*', harder materials (e.g. M3) follow the solid line trajectory and rebound further off the rebound surface 176 into M3 container 160*c*', and medium materials (e.g. M2) follow the dashed line trajectory and rebound off the rebound surface 176 between the harder and softer materials into M2 container 160*b*'.

Process

Figure 12:
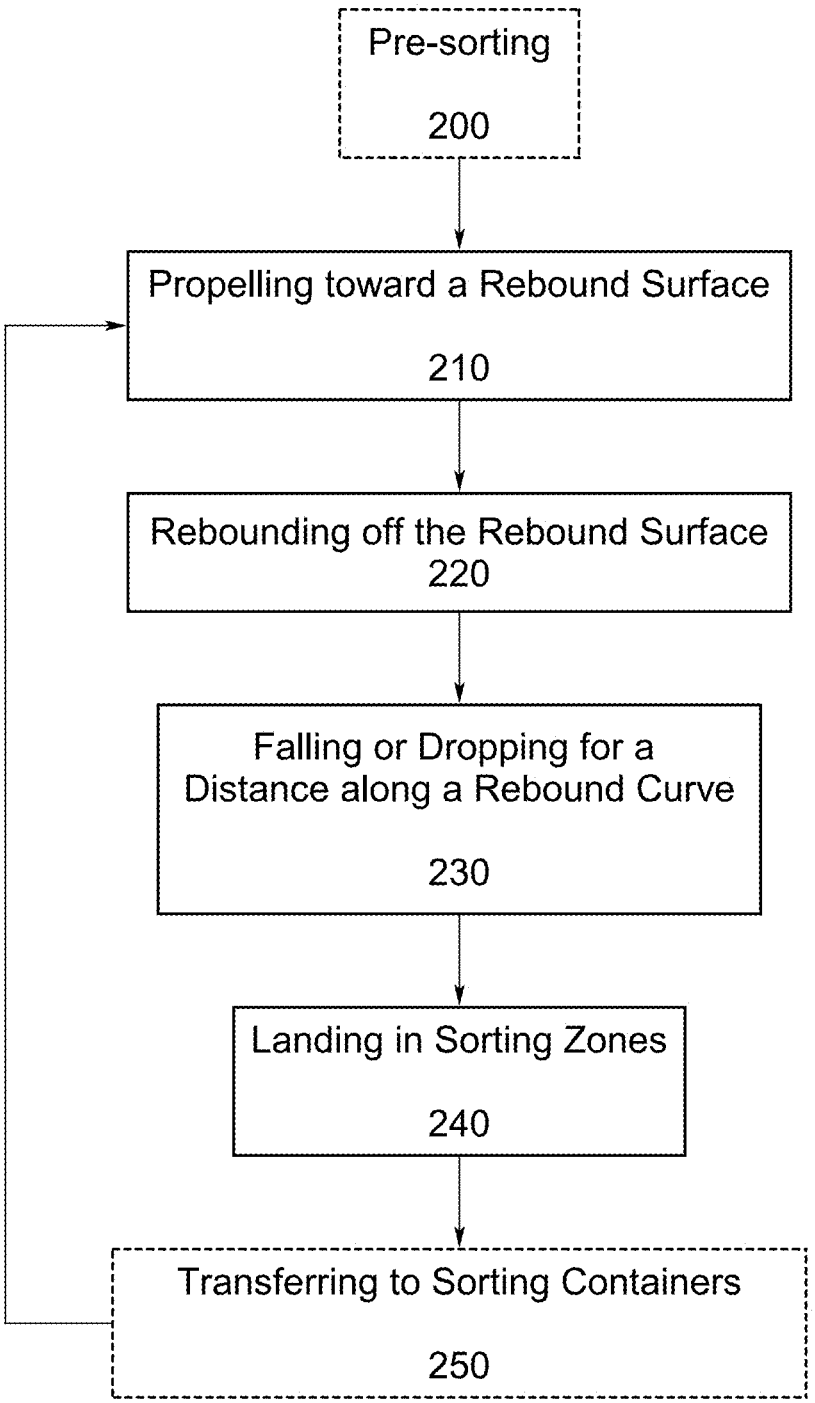
FIG. 12 is a flowchart showing an exemplary method for sorting mixed granular input material using, at least in part, a separator as described herein.

The blocks of the flow chart of FIG. 12 show an exemplary general method or process for sorting mixed granular input material using, at least in part, a separator 100, 170 as described herein. Each block supports one or more steps of the method. On the other hand, the blocks may be combined such that two blocks represent a single step. Put another way, each block and/or combination of blocks may be divided and/or joined with other blocks of the flow chart without affecting the scope of the invention. Blocks shown as dashed blocks are optional steps for some preferred methods.

Methods for using the separators 100, 170 described include, in their most basic form, the following steps:

A. propelling 210 inputted granular input material 110 (having a mixture of materials M1, M2, and M3, each material having a hardness—also referred to as a hardness characteristic) toward a rebound surface 142, 176;

B. rebounding 220 the propelled granular input material 110 off of the rebound surface 142, 176;

C. each rebounded component material M1, M2, M3 falling or dropping 230 for a distance along a rebound curve C determined by the hardness of the component material M1, M2, M3; and D. each fallen component material M1, M2, M3 landing 240 in respective sorting zones 150*a*, 150*b*, 150*c* (the sorting zones 150 being associated with the distances of the respective hardnesses of the component material M1, M2, M3).

In addition, before the step of propelling 210, the mixed granular input material 110 may be pre-sorted 200 based on characteristics including, but not limited to size, weight, shape, material, and any other characteristic known or yet to be discovered.

Further, after the step of landing 240, the separated component materials M1, M2, M3 are transferred 250 from the respective sorting zones 150*a*, 150*b*, 150*c* to respective sorting containers 160*a*, 160*b*, 160*c*.

The steps of the process may be iterative. For example, a first pass through the separator 100 may include steps 210 to 250 to sort the component materials M1, M2, M3 to a relatively "pure" state, but there could be some "errors" (e.g. where particles collided). Repeating the process would improve the purity of the resulting component materials M1, M2, M3. Put another way, the component materials in each sorting containers can be sent through the separator 100 for additional sorting. The arrow from the transferring step 250 to the propelling step 210 shows this optional iteration.

It is to be understood that the inventions, examples, and embodiments described herein are not limited to particularly exemplified materials, methods, and/or structures. It is to be understood that the inventions, examples, and embodiments described herein are to be considered preferred inventions, examples, and embodiments whether specifically identified as such or not. The shown inventions, examples, and embodiments are preferred, but are not meant to be limiting unless specifically claimed, in which case they may limit the scope of that particular claim.

It is to be understood that for methods or procedures disclosed herein that include one or more steps, actions, and/or functions for achieving the described actions and results, the methods' steps, actions, and/or functions may be interchanged with one another without departing from the scope of the present invention. In other words, unless a specific order of steps, actions, and/or functions is required for proper or operative operation of the methods or procedures, the order and/or use of specific steps, actions, and/or functions may be modified without departing from the scope of the present invention.

All references cited herein, whether supra or infra, are hereby incorporated by reference in their entirety.

The terms and expressions that have been employed in the foregoing specification are used as terms of description and not of limitation, and are not intended to exclude equivalents of the features shown and described. While the above is a complete description of selected embodiments of the present invention, it is possible to practice the invention using various alternatives, modifications, adaptations, variations, and/or combinations and their equivalents. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention that, as a matter of language, might be said to fall therebetween.

What is claimed is:

1. A separator for separating granular input material into component materials, each component material having a hardness, said separator comprising:

(a) an annular rebound surface;

(b) a centrifugal propulsion system for propelling granular input material toward said annular rebound surface; and (c) a plurality of concentric sorting zones arranged at increasing distances from said annular rebound surface, said component materials rebounded off of said annular rebound surface landing in said concentric sorting zones based on the hardness of said component materials.

2. The separator of claim 1 wherein said component materials in said concentric sorting zones are predominantly of a like hardness.

3. The separator of claim 1 further comprising a pre-sorting system, said pre-sorting system for pre-sorting said granular input material prior to said centrifugal propulsion system propelling said granular input material toward said annular rebound surface.

4. The separator of claim 1 further comprising a plurality of sorting containers, each sorting container associated with at least one of said concentric sorting zones, each sorting container receiving component material that landed in the associated at least one of said concentric sorting zones.

5. A separator for separating granular input material into component materials, each component material having a hardness, said separator comprising:

(a) an annular rebound surface;

(b) a centrifugal propulsion system for propelling granular input material toward said annular rebound surface;

(c) a plurality of concentric sorting zones arranged at increasing distances from said rebound surface, said component materials rebounded off of said annular rebound surface landing in said concentric sorting zones based on the hardness of said component materials; and (d) a plurality of sorting containers, each sorting container associated with at least one of said concentric sorting zones, each sorting container receiving component material that landed in the associated at least one of said concentric sorting zones;

(e) wherein said component materials in said sorting containers are predominantly of a like hardness.

6. The separator of claim 5 further comprising a pre-sorting system, said pre-sorting system for pre-sorting said granular input material prior to said centrifugal propulsion system propelling said granular input material toward said annular rebound surface.

7. A method for using a separator for separating granular input material into component materials, each component material having a hardness, said method comprising the steps of:

(a) using a centrifugal propulsion system, propelling inputted granular input material toward an annular rebound surface;

(b) rebounding propelled granular input material off of said annular rebound surface; and (c) said component materials rebounding off of said annular rebound surface and landing in respective ones of a plurality of concentric sorting zones based on the hardness of said component materials, said plurality of concentric sorting zones arranged at increasing distances from said annular rebound surface and landing in respective ones of a plurality of concentric sorting zones based on the hardness of said component materials.

8. The method of claim 7 further comprising the step of pre-sorting said granular input material prior to the step of propelling inputted granular input material.

* * * * *